US005255578A

United States Patent [19]

Liou

[11] Patent Number: 5,255,578

[45] Date of Patent: Oct. 26, 1993

[54] WRENCH HAVING A POSITIONING DEVICE

[76] Inventor: Mou-Tang Liou, No. 25, Lane 86, Tawei Rd., Tali Hsiang, Taichung Hsien, Taiwan

[21] Appl. No.: 968,163

[22] Filed: Oct. 29, 1992

[51] Int. Cl.[5] ..... B25B 13/06

[52] U.S. Cl. ..... 81/125; 81/124.7; 81/177.1

[58] Field of Search ..... 81/180.1, 119, 121.1, 81/122, 125, 124.7, 177.1, 462, 184, 487, 488

[56] References Cited

U.S. PATENT DOCUMENTS 3,447,405 6/1969 Lennon et al. ..... 81/119

4,823,652 4/1989 Morrissey et al. ..... 81/125

*Primary Examiner*—D. S. Meislin

*Attorney, Agent, or Firm*—Hedman, Gibson & Costigan

[57] ABSTRACT

A wrench includes a positioning device for engagement with an object to be driven in order to retain the object in place relative to the head portion of the wrench. The positioning device includes a protrusion formed on the head portion, a depression formed in the protrusion, a spring and a stub received in the depression. The stub is biased outward of the protrusion for engagement with the object.

7 Claims, 3 Drawing Sheets

WRENCH HAVING A POSITIONING DEVICE

BACKGROUND OF THE INVENTION

1. Field of the Invention

The present invention relates to a wrench, and more particularly to a wrench having a positioning device.

2. Description of the Prior Art

A typical wrench is shown in FIG. 5 and comprises a head portion 51 formed integral on one end of a handle portion 50 for engagement with a nut 60 so as to drive the nut 60 to rotate relative to the bolt 70. However, the wrenches have no positioning devices provided therein such that the head portion 51 should be retained in place relative to the nut 60 by the hands of the users. This is inconvenient.

The present invention has arisen to mitigate and/or obviate the afore-described disadvantages of the conventional wrenches.

SUMMARY OF THE INVENTION

The primary objective of the present invention is to provide a wrench having a positioning device in order to retain the head portion of the wrench in place relative to the object to be driven.

In accordance with one aspect- of the invention, there is provided a wrench for driving an object comprising a head portion for engagement with the object to be driven, a handle portion formed integral with the head portion, a protrusion formed on the head portion and including a depression formed therein, a biasing means and a stub received in the depression, the stub including a projection biased outward of the protrusion for engagement with the object, whereby, the object is retained in place relative to the head portion.

It is preferable that a bent portion is formed on the handle portion adjacent to the head portion, the protrusion is preferably formed in the bent portion and formed on the head portion and arranged such that the projection may extend into the range of the engaging surface of the head portion so as to engage with the object to be driven, and such that the head portion can be retained in place relative to the object.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
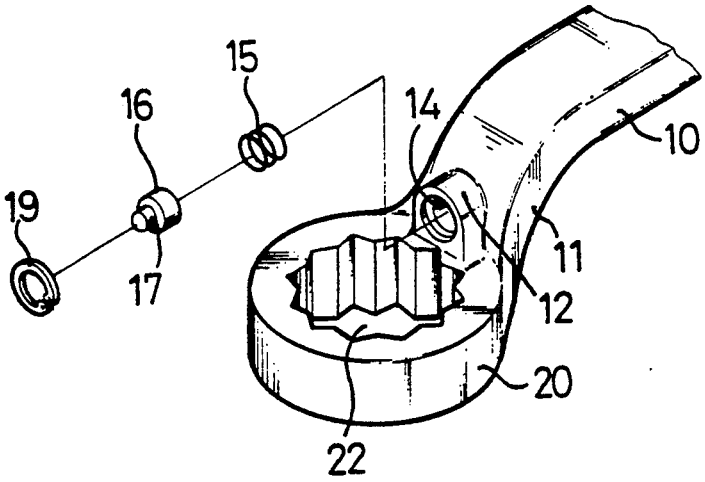
FIG. 1 is a partial exploded view of a wrench in accordance with the present invention.
Figure 2:
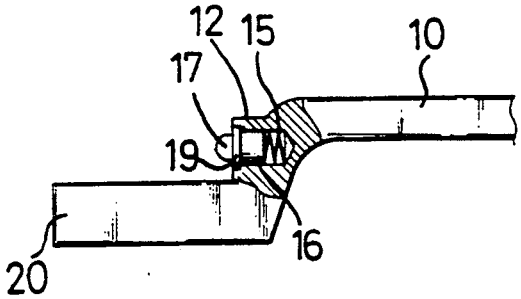
FIG. 2 is a partial cross sectional view of the wrench.

Referring to the drawings, and initially to FIGS. 1 and 2, a wrench in accordance with the present invention comprises generally a handle portion 10 having a head portion 20 formed integral therewith, an engaging surface 22 formed in the head portion 20, a bent portion 11 formed in the end portion of the handle portion adjacent to the head portion 20, a protrusion 12 formed on the head portion 20 and located above the head portion 20 and having a depression 14 formed therein, a spring 15 and a stub 16 received in the depression 14 and retained in place by a ring element 19, such as a C-clamp, the stub 16 including a projection 17 of smaller diameter extended therefrom and extended outward of the protrusion 12 through the ring element 19.

Figure 3:
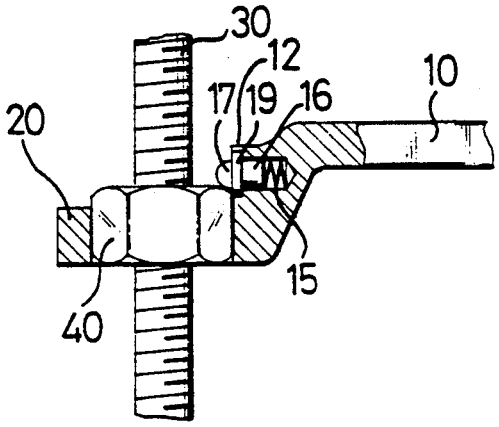
FIGS. 3 and 4 are partial cross sectional views illustrating the operations of the wrench.
Figure 4:
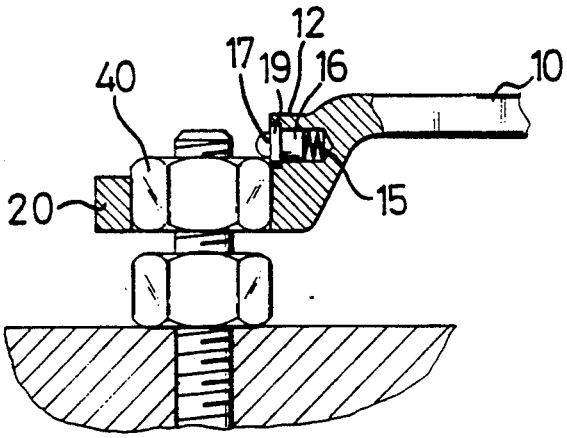
Figure 5:
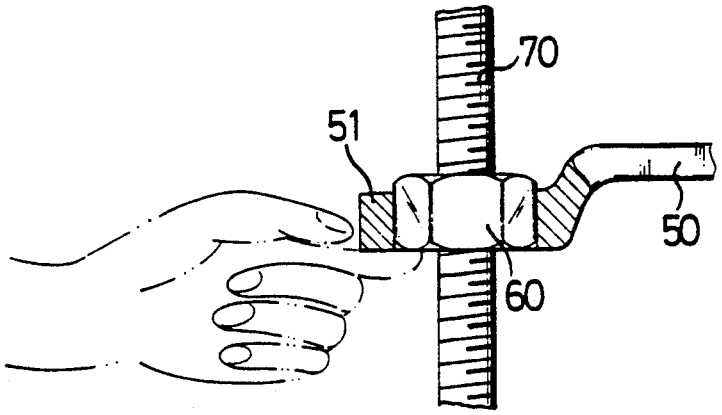
FIG. 5 PRIOR ART
FIG. 5 is a schematic view illustrating a typical wrench.

As best shown in FIGS. 2, 3 and 4 the projection 17 extends into the range of the engaging surface 22 of the head portion 20 and may engage with the nut 40 to be driven along the bolt 30 such that the head portion 20 can be retained in place relative to the nut 40 without the help of the hands.

Accordingly, the wrench in accordance with the present invention includes a positioning device for retaining the head portion in place relative to the object to be driven.

Alternatively, the protrusion 12 may be formed on the perimeter portion of the head portion 20, and the head portion 20 and the handle portion 10 can be made flat without the bent portion 11 formed therebetween.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench for driving an object comprising a head portion including an engaging surfaced for engagement with said object to be driven, a handle portion formed integral with said head portion, a protrusion formed on said head portion and located beyond and said engaging surface of said head portion, and positioning means disposed in said protrusion and extended outward of said protrusion for engagement with said object, whereby, said object is retained in place relative to said head portion.

2. A wrench according to claim 1, wherein said handle portion includes a bent portion formed thereon and adjacent to said head portion, said protrusion is also formed on said bent portion.

3. A wrench according to claim 1, wherein said protrusion includes a depression formed therein, said positioning means includes a spring and a stub received in said depression, said stub includes a projection biased outward of said protrusion for engagement with said object,

4. A wrench for driving an object comprising a head portion for engagement with said object to be driven, a handle portion including a bent portion formed on one end thereof and formed integral with said head portion, a protrusion formed on said head portion and formed in said bent portion of said handle portion, and positioning means disposed in said protrusion and extended outward of said protrusion for engagement with said object, whereby, said object is retained in place relative to said head portion.

5. A wrench according to claim 4, wherein said protrusion includes a depression formed therein, said positioning means includes spring and a stub received in said depression, said stub includes a projection biased outward of said protrusion for engagement with said object.

6. A wrench for driving an object comprising a head portion including an engaging surface for engagement with said object to be driven, a handle portion formed integral with said head portion, a protrusion formed on said head portion and including a depression formed therein and located beyond said engaging surface of said head portion, a biasing means and a stub received in said depression, said stub including a projection biased outward of said protrusion for engagement with said object, whereby, said object is retained in place relative to said head portion.

7. A wrench according to claim 6, wherein said handle portion includes a bent portion formed thereon and adjacent to said head portion, said protrusion is also formed on said bent portion.

* * * * *